United States Patent [19]

Bourn

[11] 4,125,361

[45] Nov. 14, 1978

[54] BAFFLE

[75] Inventor: Ronald L. Bourn, Cowes, England

[73] Assignee: The British Petroleum Company Limited, Sunbury-on-Thames, England

[21] Appl. No.: 736,312

[22] Filed: Oct. 28, 1976

[30] Foreign Application Priority Data

Nov. 12, 1975 [GB] United Kingdom ..... 46688/75

[51] Int. Cl.[2] ..... F23D 13/40

[52] U.S. Cl. ..... 431/354; 239/DIG. 7; 431/202

[58] Field of Search ..... 431/202, 239, 354, 350, 431/8; 239/DIG. 7, 433

[56] References Cited

U.S. PATENT DOCUMENTS

| | | | |
|---|---|---|---|
| 589,085 | 8/1897 | Hermance | 165/103 |
| 3,091,284 | 5/1963 | Burklin | 431/350 |
| 3,695,820 | 10/1972 | Hawkes et al. | 431/354 |
| 3,806,039 | 4/1974 | Mocarski | 239/433 |
| 3,850,581 | 11/1974 | Hills et al. | 431/202 |
| 3,853,457 | 10/1974 | Desty et al. | 431/202 |

FOREIGN PATENT DOCUMENTS

| | | | |
|---|---|---|---|
| 1,278,577 | 3/1969 | United Kingdom | 431/354 |

*Primary Examiner*—Edward G. Favors

*Attorney, Agent, or Firm*—Morgan, Finnegan, Pine, Foley & Lee

[57] ABSTRACT

A burner has a flow tube along which passes a high pressure fuel gas from a Coanda nozzle at one end of the tube. The other end of the tube is divergent in the manner of a venturi in the gas flow direction. A peripheral ring is situated at the divergent outlet end which separates off the fuel gas and entrained air layer passing along the interior wall of the flow tube from the central gas flow and deflects this fuel fuel/air layer outwardly from the central gas flow.

14 Claims, 2 Drawing Figure

Figure 1:
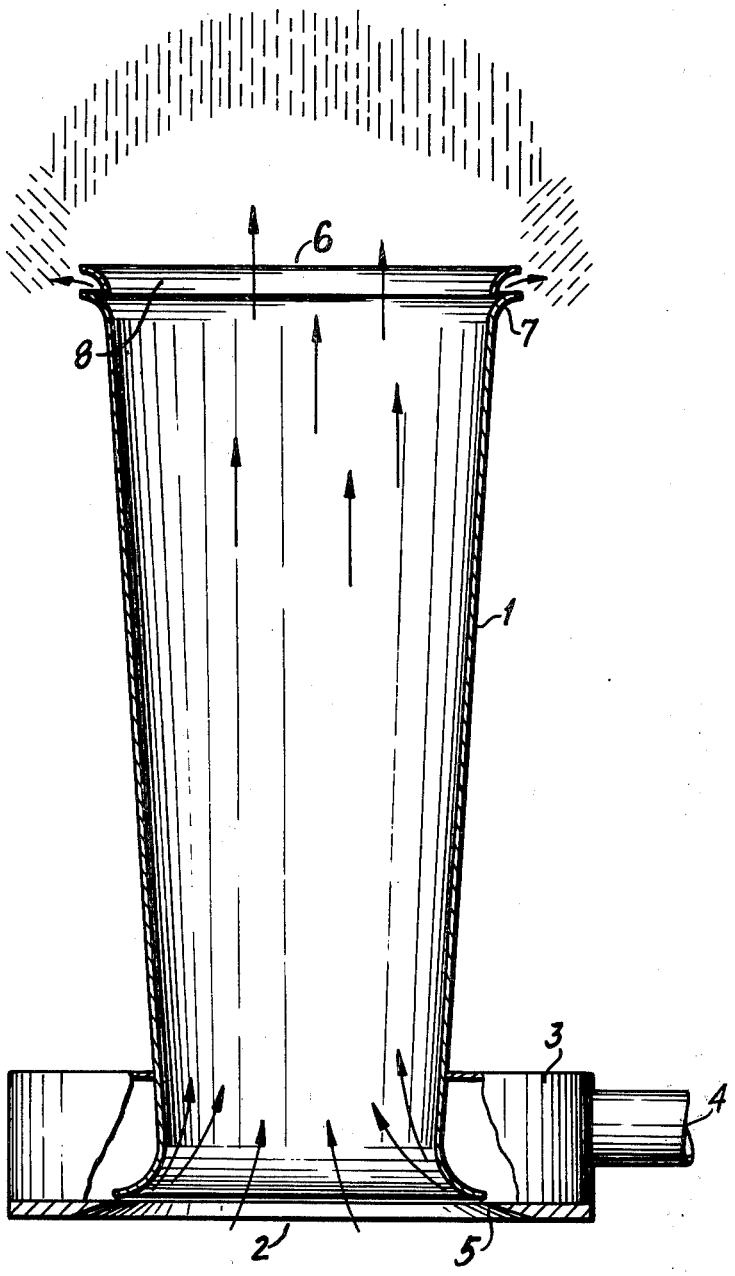

6
8
7
1
3
4
2
5

BAFFLE

This invention relates to a flare for disposing of combustible gases from e.g. marine platforms, and in particular it relates to the disposal of petroleum gas during emergency situations.

The flaring off of gases from production units situated on marine platforms presents special problems. In view of the limited space available on the platform the flame arising from the flare must either have low radiation of heat or be shielded so as to protect personnel from radiation, flame lick and high temperature flue gas impingement. A further requirement is that the noise arising from the flaring procedure is not excessive.

Conventional flares are not very suitable on limited marine platform areas the resultant long flames being difficult to shield with the consequent radiation and flame lick hazards.

U.K. Pat. No. 1,426,333 discloses a burner element comprising a fuel chamber through which pass a plurality of first tubes, there being means for reducing gas velocity comprising second tubes of increasing cross-sectional area attached each to the exit of a respective one of the plurality of first tubes, the second tubes being separated from each other by atmospheric air space, and the interior of the fuel chamber being connected to the bores of each of said plurality of first tubes only by means of a respective Coanda nozzle for each first tube so that, during use of the burner element, gas fuel passes from the fuel chamber into the first tubes via the Coanda nozzles thus entraining surrounding air into the fuel flow, the fuel and air then passing through the first tube exits and via said second tubes to a combustion zone.

The present invention relates to a development of the above invention which improves flame stabilisation.

It is known that when the extension of one lip of the mouth of a slot through which a fluid emerges under pressure, progressively diverges from the axis of the exit of the slot, the extended lip thus creates a pressure drop in the surrounding fluid causing fluid flow towards the low pressure region. This physical phenomenon is known as the Coanda effect and a body exhibiting this effect is known as a Coanda body. A Coanda nozzle may thus be defined as a nozzle capable of discharging a fluid at high pressure into another fluid of low pressure through a narrow slot of chosen dimensions having a surface of a Coanda body substantially contiguous with one wall of the slot.

Thus, according to the present invention there is provided a burner element comprising a flow tube, one end of which flow tube has a Coanda nozzle adapted to pass a pressurised fuel gas together with entrained surrounding gas along the inside of the flow tube, the flow tube diverging (in the direction of gas flow) to an outlet portion, the outlet portion having means for separating off the fuel gas and entrained gas layer passing adjacent to the interior wall of the flow tube from the central gas flow and for deflecting the fuel gas and entrained gas layer outwardly from the central gas flow.

By separating off the fuel rich mixture passing along the interior wall of the flow tube (or trumpet), it has been found that a secondary flame is formed which spreads out in a horizontal ring from the trumpet mouth. This secondary flame apparently acts to hold the primary (leaner fuel gas/air mixture) flame from the central gas flow onto the mouth of the flow tube.

Preferably the flow tube takes the form of a truncated cone.

The most preferred embodiment for separating off and deflecting the fuel gas and entrained air layer passing along the interior wall of the flow tube comprises a flame retention ring spaced apart from the outlet portion of the flow tube wall.

It is desirable that the flame retention ring or other separating means, separate off the fuel rich gas mixture without significantly reducing the Coanda air entrainment which exists when the ring or separating means is not present. This may be achieved, for example, by making the flame retention ring as thin as possible consistent with mechanical stability.

In one embodiment of the invention the flame retention ring comprises an inverted truncated hollow cone having an included angle greater than that of the flow tube and at least a part of which is within the flow tube.

In a second embodiment the outlet portion of the flow tube is turned out to form a lip, the end of which is most preferably perpendicular to the central gas flow axis. The lip preferably has the cross-section of the arc of a circle.

Preferably the cross-section of the flame retention ring is curved, most preferably taking the form of the arc of a circle.

The distance of separation between the flame retention ring and the lip of the flow tube wall is small compared to the outlet (internal) diameter of the flow tube, e.g. from 2 to 5%.

The gap between the flame retention ring and the flow tube wall is typically 5 to 10 mms. for an outlet internal diameter of 350 mms.

Also it is preferred that, in the second embodiment, the inner edge of the flame retention ring i.e., the edge of the ring nearer the throat of the Coanda trumpet is on or out of the line of sight looking along the inner wall of the diverging section of the trumpet looking from the throat to the mouth of the trumpet. This feature reduces the formation of turbulent gas flow and helps Coanda air entrainment. Also preferably the cross-sectional area between the flame retention ring and the outlet of the flow tube increases in the direction of gas flow.

A particularly suitable use for the present invention is in association with the self adjustable slot Coanda unit disclosed in United States patent application Ser. No. 489,085, filed June 23, 1975, now U.S. Pat. No. 4,073,613.

Depending upon the quantity of gas to be flared, a number of Coanda burner elements may be built into an array. Preferably the centre of each Coanda burner element of the array is separated by a distance of 2 to 3 trumpet exit diameters. This arrangement assists optimum secondary air entrainment to be achieved.

During use of the element in a flare it is preferably to incorporate pilot lights. Preferably, particularly during use on a marine platform, radiation and/or wind shields are associated with the flare.

The invention will now be described by way of example only with reference to the drawings accompanying the Specification.

Figure 2:
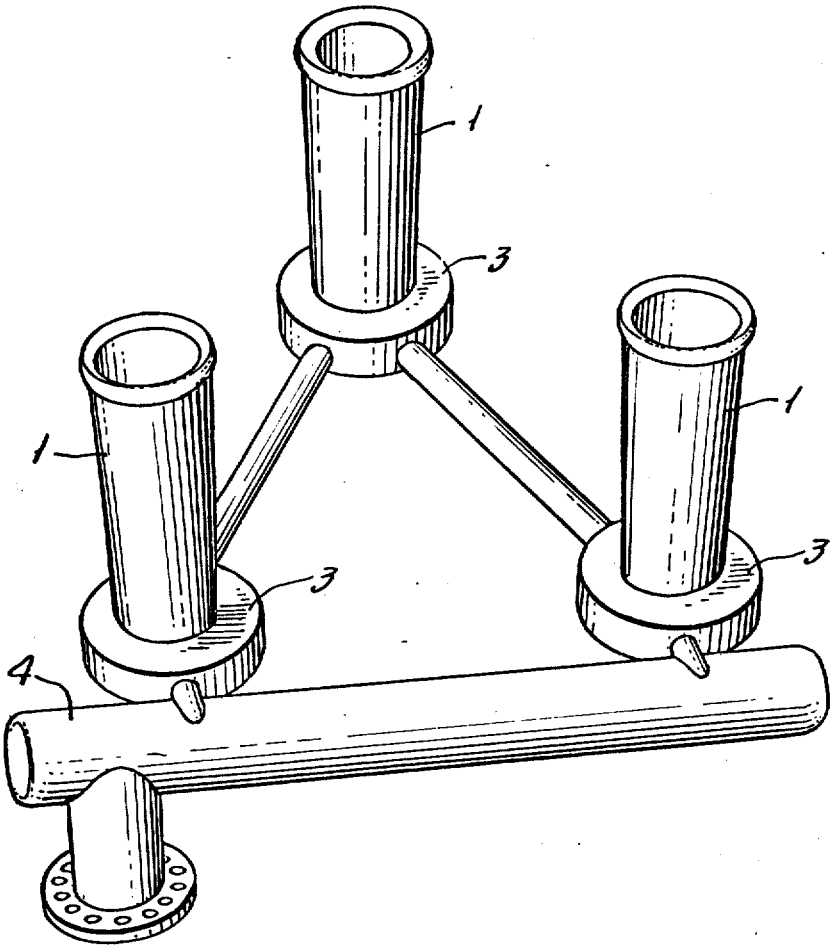

FIG. 1 is a sectional view, partially in elevation, of a burner element constructed in accordance with the present invention; and FIG. 2 is a perspective view of an array of the burner elements of FIG. 1 arranged in accordance with the present invention.

The burner shown in FIG. 1 comprises a flow tube or trumpet 1 whose inlet end 2 is surrounded by a fuel chamber 3 which has an inlet 4 for receiving fuel in the gaseous phase. The fuel chamber 3 opens into the flow tube 1 via a slot 5 which extends around the whole circumference of the inlet end 2 and which has the configuration of a Coanda nozzle.

The properties of the Coanda nozzle are such that the fuel flow stays close to the wall and the fuel flow aspirates enough air through the flow tube 1 to provide a combustible fuel gas/air mixture which is burned at the combustion zone.

At the outlet end 6 of the flow tube 1, the lip 7 is turned outward to a horizontal or almost horizontal position. A flame retention ring 8 (the supports are not shown) is fitted to the lip 7 and the ring 8 is parallel to and of a similar curvature to the lip 7.

During use of the burner, fuel gas supplied under pressure to fuel chamber 3 emerges from the Coanda nozzle slot 5. The Coanda effect causes the emergent gas to cling to the Coanda surface and to entrain surrounding air from the inlet end 2 of the flow tube 1. The fuel gas and entrained air then pass along the flow tube 1 towards its outlet 6.

The flow tends to consist of a core of lean fuel/air mixture surrounded by an annulus of rich fuel/air mixture. The flame retention ring 8 separates of the fuel rich annulus of gas and direct it outward.

On ignition of the burner, the action of the flame retention ring 8 creates a secondary flame extending around and outwards of the flow tube outlet 6 which tends to retain the primary flame above the outlet mouth 6 of the flow tube 1.

The dimensions of a typical Coanda burner element used are as follows:

| | |
|---|---|
| Coanda trumpet mouth diameter | = 350 mm |
| Coanda trumpet throat diameter | = 217 mm |
| Coanda trumpet semi-included angle | = 3.5° |
| Coanda trumpet length (throat-mouth) | = 550 mm |
| Distance between flame retention ring and internal trumpet wall | = 8 mms at the upstream end and 11 mms at the downstream end |
| Total gas flow per element | = up to 4.5 million standard cubic feet per day |
| Pressure range in gas inlet manifold | = 0 to 73 p.s.i. |

FIG. 2 illustrates an array as shown in FIG. 2 of three burner elements constructed in the manner described for FIG. 1 and arranged in accordance with the invention such that the centre of each burner flow tube or trumpet 1 is separated by a distance of from 2 to 3 trumpet exit diameters.

A three element Coanda array as shown in FIG. 2 was operated with combustible gas (natural gas) at 35 psig and a measured flow rate of 8.75 MMscfd and a spacing of centres of three trumpet exit diameters. The resultant flame was virtually non-luminous and had an estimated height of 20 feet. The flare was operated fro 1 hour under steady conditions and during this time the structure of the flare remained relatively cool (160° C.).

The flare units continued to operate satisfactorily as the pressure was reduced to 2 psig at which point the flame front moved down into the mouth of the trumpet where burning continued until extinction at zero pressure.

I claim:

1. A burner element comprising a flow tube, one end of which flow tube has a Coanda nozzle adapted to pass a pressurised fuel gas together with entrained surrounding gas along the inside of the flow tube, the flow tube diverging (in the direction of gas flow) to an outlet portion, the outlet portion having means for separating off the fuel gas and entrained gas layer passing adjacent to the interior wall of the flow tube from the central gas flow and for deflecting the fuel gas and entrained gas layer outwardly from the central gas flow.

2. A burner element according to claim 1 in which the flow tube comprises a truncated cone.

3. A burner element according to claim 1 in which the means for separating off and deflecting the fuel gas and entrained air layer passing along the interior wall of the flow tube comprises a flame retention ring spaced apart from the outlet portion of the flow tube wall.

4. A burner element according to claim 3 in which the flame retention ring comprises an inverted hollow truncated cone having an included angle greater than that of the flow tube, said inverted truncated cone having at least a part within the flow tube.

5. A burner element according to claim 1 in which the outlet portion of the flow tube is turned out to form a lip.

6. A burner element according to claim 5 in which the lip is turned out at right angles to the central gas flow axis.

7. A burner element according to claim 5 in which the lip has the cross section of an arc of a circle.

8. A burner element according to claim 5 in which the flame retention ring has a curved cross section which is similar to and spaced apart from the outlet section of the flow tube.

9. A burner element according to claim 8 in which the curved cross-section takes the form of an arc of a circle.

10. A burner element according to claim 8 in which the edge of the flame retention ring nearer to the throat of the flow tube is on or out of the line of sight along the inner wall of the diverging flow tube.

11. A burner element according to claim 3 in which the cross-sectional area between the flame retention ring and the outlet of the flow tube increases in the direction of gas flow.

12. A burner element according to claim 3 in which the distance of separation between the flame retention ring and the outlet of the flow tube is from 2% to 5% of the outlet diameter.

13. A burner element according to claim 1 in which the Coanda nozzle has a means for maintaining a substantially constant gas pressure across its outlet slot.

14. An array of burner elements as claimed in any of the preceding claims in which the centre of each burner element is separated from its neighbour by a distance of more than twice the flow tube exit diameter.

* * * * *

UNITED STATES PATENT AND TRADEMARK OFFICE

CERTIFICATE OF CORRECTION

PATENT NO. : 4,125,361

DATED : November 14, 1978

INVENTOR(S) : Ronald L. Bourn

It is certified that error appears in the above-identified patent and that said Letters Patent are hereby corrected as shown below:

Title page, column 2, last line, "2 Drawing Figure" should read -- 2 Drawing Figures --. Column 2, line 56, "preferably" should read -- preferable --. Column 3, line 49, cancel "as shown in FIG. 2". Column 4, lines 58-59, cancel "any of the preceding claims" and substitute therefor -- claim 1 --.

In the drawings, -- FIGURE 1 -- should be added to the single sheet of drawing and the attached FIGURE 2 should be added.

Signed and Sealed this

*Eighteenth* Day of *September 1979*

[SEAL]

*Attest:*

*Attesting Officer*

LUTRELLE F. PARKER

*Acting Commissioner of Patents and Trademarks*